US008845081B2

(12) United States Patent
Oikawa et al.

(10) Patent No.: US 8,845,081 B2
(45) Date of Patent: Sep. 30, 2014

(54) LIQUID DISCHARGE HEAD

(75) Inventors: Masaki Oikawa, Inagi (JP); Keiji Tomizawa, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 97 days.

(21) Appl. No.: 13/605,686

(22) Filed: Sep. 6, 2012

(65) Prior Publication Data

US 2013/0076835 A1 Mar. 28, 2013

(30) Foreign Application Priority Data

Sep. 22, 2011 (JP) ..... 2011-207694

(51) Int. Cl.
*B41J 2/05* (2006.01)
*B41J 2/04* (2006.01)
*B41J 2/14* (2006.01)

(52) U.S. Cl.
CPC .... *B41J 2/14145* (2013.01); *B41J 2002/14403* (2013.01); *B41J 2002/14467* (2013.01); *B41J 2/1404* (2013.01)
USPC ..... 347/65; 347/54

(58) Field of Classification Search
None
See application file for complete search history.

(56) References Cited

U.S. PATENT DOCUMENTS 4,746,935 A * 5/1988 Allen ..... 347/98

FOREIGN PATENT DOCUMENTS

JP 2005-028741 * 2/2005 ..... B41J 2/18
JP 2005-28741 A 2/2005

* cited by examiner

*Primary Examiner* — Geoffrey Mruk
(74) *Attorney, Agent, or Firm* — Canon USA, Inc. IP Division

(57) ABSTRACT

A liquid discharge head includes a plurality of discharge ports configured to discharge liquid, a supply port configured to retain the liquid to be discharged from the plurality of discharge ports, a first pressure chamber including a first energy generation element to discharge a predetermined amount of liquid droplets, a second pressure chamber including a second energy generation element to discharge an amount of liquid droplets greater than the predetermined amount, a first flow path through which the supply port and the first pressure chamber communicate with each other, and a second flow path through which the first pressure chamber and the second pressure chamber communicate with each other.

13 Claims, 16 Drawing Sheets

LIQUID DISCHARGE HEAD

BACKGROUND OF THE INVENTION

1. Field of the Invention

Aspects of the present invention generally relate to an inkjet liquid discharge head for discharging liquid such as ink to perform recording on a recording medium.

2. Description of the Related Art

Among inkjet recording methods, a method for discharging ink droplets having different sizes to express gradations has been known. Particularly, recording dots including relatively small ink droplets are provided from a light portion to a halftone portion of an image, whereas recording dots including relatively large ink droplets are provided from the halftone portion to a dark portion of the image. A cross-sectional area and a flow path resistance of an ink supply path and a flow path are adjusted according to sizes of the liquid droplets so that different sizes of the ink droplets are formed.

Since a discharge port positioned in a leading edge of a flow path is exposed to the air, moisture is evaporated from the discharge port while discharge is not being performed. Consequently, if supply of moisture from the flow path is too late, the density of solvent and dye included in ink increases or viscosity of the ink increases at the leading edge of the flow path. Such an increase in density or viscosity causes an increase in print density. Moreover, when ink is not discharged for a certain time period, there are cases where a liquid droplet supposed to be discharged first is not discharged from a discharge port, or a liquid droplet discharged first from a discharge port is obliquely discharged.

Japanese Patent Application Laid-Open No. 2005-28741 discusses a discharge port (hereinafter referred to as a large discharge port) for discharging large liquid droplets and a discharge port (hereinafter referred to as a small discharge port) for discharging small liquid droplets are arranged serially adjacent to each other in one flow path such that the small discharge port is positioned on an upstream side relative to an ink supply direction. When large liquid droplets are discharged from the large discharge port, and then the large discharge port is refilled, the ink near the small discharge port is refreshed by flow of ink.

In a liquid discharge head, printing discharge and preliminary discharge are known as two ink discharge modes. The printing discharge is discharge of ink to print the ink on a print medium. The preliminary discharge is discharge of ink to refresh ink inside a flow path, and is performed in a preliminary discharge position different from a printing position inside an inkjet recording apparatus, the printing position being in which ink is printed on a print medium.

According to a configuration discussed in Japanese Patent Application Laid-Open No. 2005-28741, printing discharge using a large discharge port can refresh ink. However, when a small discharge port and a large discharge port are simultaneously used for printing discharge, or a small discharge port is used immediately after a large discharge port is used for printing discharge, there are cases where an ink full state of the small discharge port is disturbed. Since the small discharge port and the large discharge port are provided adjacent to each other, such cases occur due to influences of ink flow and pressure wave caused by discharge of liquid droplets from the large discharge port and refill of liquid droplets. Consequently, normal discharge is unlikely to be performed from the small discharge port.

When a small discharge port and a large discharge port are simultaneously used for preliminary discharge, or a small discharge port is used immediately after a large discharge port is used for preliminary discharge, an ink full state of the small discharge port is disturbed by similar reasons as the printing discharge. Consequently, normal preliminary discharge is unlikely to be performed from the small discharge port. Thus, the preliminary discharge using the small discharge port and the large discharge port needs to be temporally separated. Although the preliminary discharge is performed in a preliminary discharge position, a printing operation cannot be performed during the preliminary discharge, thereby causing a reduction of printing speed.

SUMMARY OF THE INVENTION

According to an aspect of the present invention, a liquid discharge head includes a plurality of discharge ports configured to discharge liquid, a supply port configured to retain the liquid to be discharged from the plurality of discharge ports, a first pressure chamber including a first energy generation element to discharge a predetermined amount of liquid droplets, a second pressure chamber including a second energy generation element to discharge an amount of liquid droplets greater than the predetermined amount, a first flow path through which the supply port and the first pressure chamber communicate with each other, and a second flow path through which the first pressure chamber and the second pressure chamber communicate with each other.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 1:
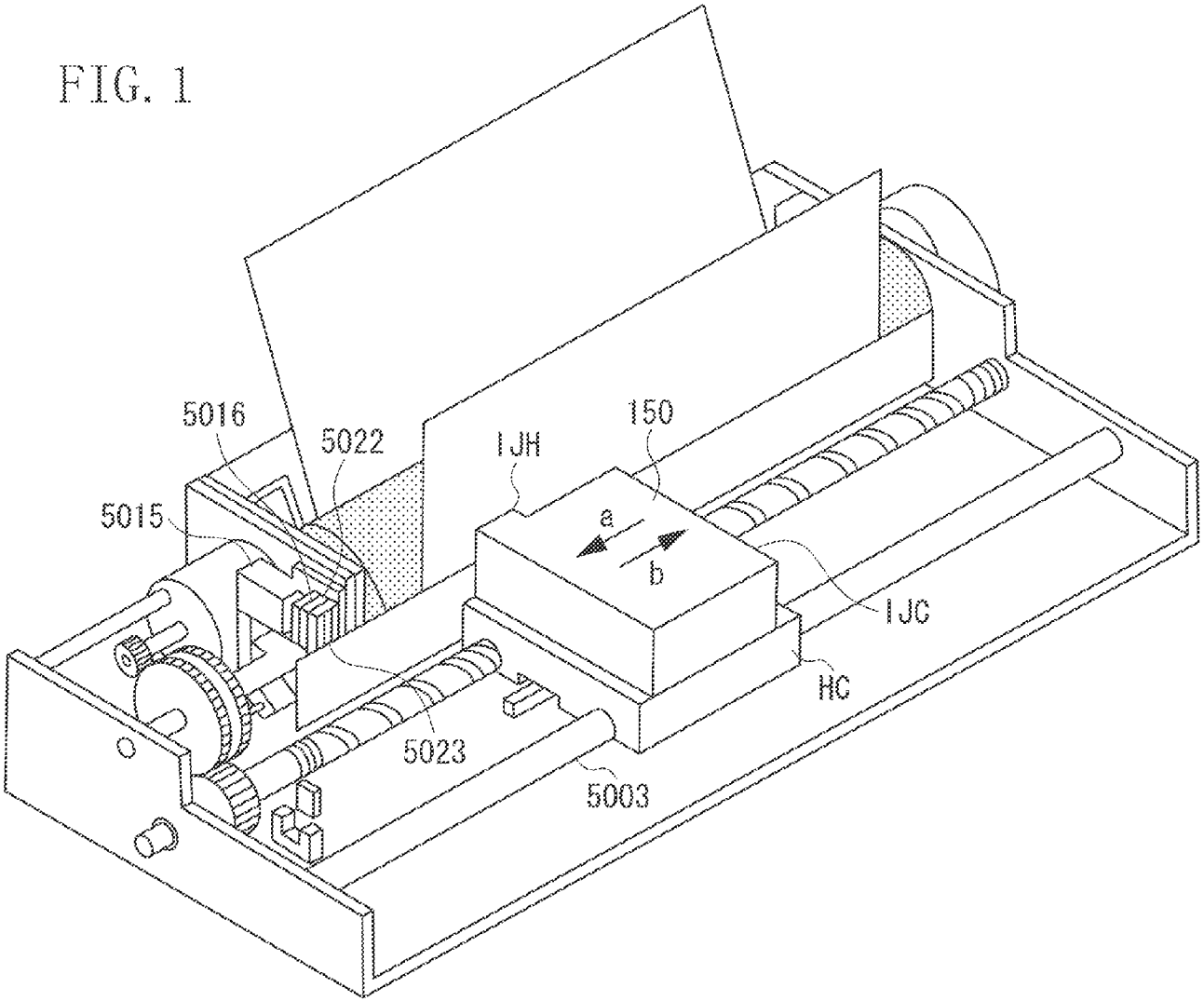
FIG. 1 is a perspective view illustrating an inkjet printer capable of using a liquid discharge head according to an exemplary embodiment.

FIG. 1 is a perspective view illustrating an inkjet printer capable of using a liquid discharge head (also referred to as a recording head) according to an exemplary embodiment of the present invention. A carriage HC includes an integrated inkjet cartridge IJC in which a liquid discharge head IJH and an ink tank (ink supply member) 150 are installed. The carriage HC performs printing by making a reciprocating movement on a print medium surface in directions indicated by arrows a and b illustrated in FIG. 1 while being supported by a guide rail 5003. In a preliminary discharge position, a cap member 5022 for capping a front surface of the recording head IJH is supported by a member 5016. An opening 5023 of the cap member 5022 is suctioned by a suction device 5015, and the liquid discharge head IJH is recovered through the opening 5023.

The liquid discharge head according to the present exemplary embodiment includes a unit for generating heat energy used to discharge liquid such as ink, and causes an ink state to be changed by the heat energy. According to this method, characters or images to be recorded can be readily provided with high density and high definition. In the present exemplary embodiment, an electrothermal conversion element is employed as the unit for generating heat energy. This electrothermal conversion element heats ink. The ink undergoes film boiling and then generates bubbles so that the ink is discharged by pressure exerted by the bubbles. Herein, the liquid discharge head for discharging the ink for printing is described. However, liquid to be discharged is not limited to the ink. For example, optional liquid may be used.

Figure 2:
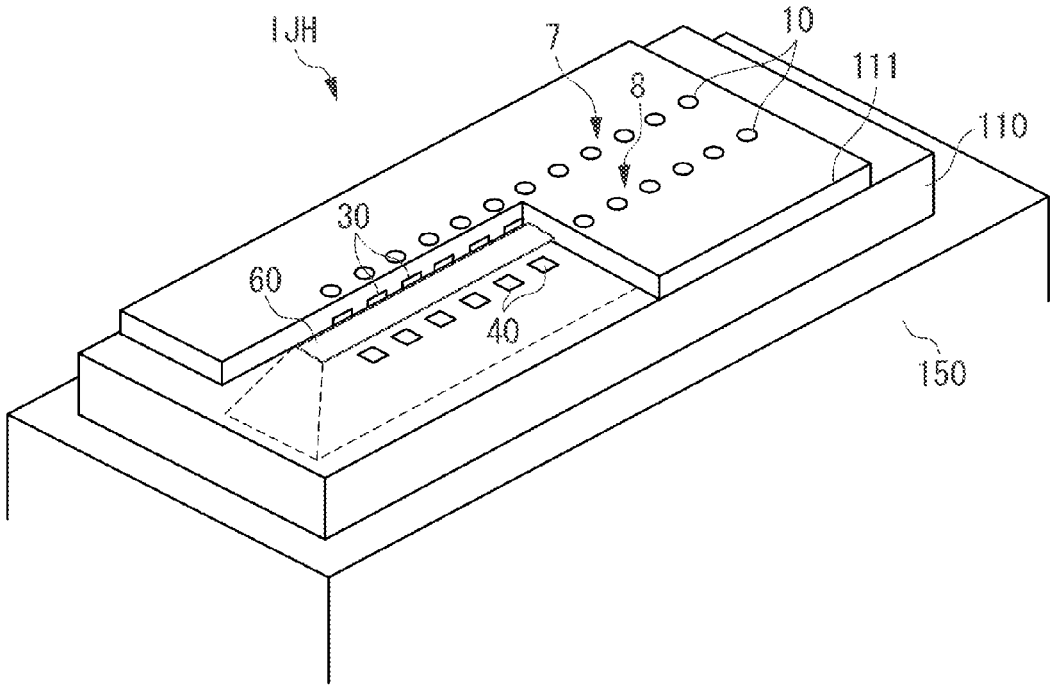
FIG. 2 is a perspective sectional view partially illustrating the liquid discharge head according to the exemplary embodiment.

FIG. 2 is a perspective cutaway view partially illustrating an example of a liquid discharge head (hereinafter called a recording head) according to the present exemplary embodiment. The recording head IJH includes an element substrate 110 including a plurality of energy generation elements (heaters) 40 serving as electrothermal conversion elements, and a flow path forming member 111 for forming a plurality of ink flow paths. The flow path forming member 111 is laminated on and bonded to a principal surface of the element substrate 110.

The element substrate 110 is made of, for example, glass, ceramics, resin, or metal, and is generally made of silicon (Si). On the principal surface of the element substrate 110, the heater 40 and an electrode (not illustrated) for applying voltage to the heater 40 are formed for each ink flow path, and each wiring (not illustrated) connected to the electrode is provided in a predetermined wiring pattern. On the principal surface of the element substrate 110, an insulating film (not illustrated) is provided to cover the heater 40. The insulating film enhances divergence of thermal accumulation. On the principal surface of the element substrate 110, moreover, a protection film (not illustrated) is provided to cover the insulating film. The protection film protects the insulating film from cavitation generated upon debubbling of the bubbles. Moreover, the element substrate 110 has a supply port 60 for supplying ink to the flow path 30.

As illustrated in FIG. 2, the flow path forming member 111 includes a groove portion to form a plurality of flow paths 30 in which ink flows. Moreover, the flow path forming member 111 has a plurality of discharge ports 10 serving as edge openings for discharging ink droplets. The discharge port 10 is formed in a position opposite to the heater 40 of the flow path forming member 111.

The recording head IJH includes the plurality of heaters 40 and the plurality of flow paths 30 on the element substrate 110. The recording head IJH generally includes a first discharge port array 7 and a second discharge port array 8 positioned opposite to the first discharge port array 7 with the supply port 60 therebetween. The first discharge port array 7 is arranged such that a longitudinal direction of each flow path 30 is arranged in parallel, and the second discharge port array 8 is arranged such that a longitudinal direction of each of the flow paths 30 is arranged in parallel. The first and second discharge port arrays 7 and 8 are arranged to provide space between the discharge ports 10 adjacent to each other such that 600 dot per inch (dpi) or 1200 dpi is formed.

In each of the following exemplary embodiments, a second discharge port array may be omitted, or a third or fourth discharge port array (not illustrated) parallel to first and second discharge port arrays may be provided. In each exemplary embodiment, a supply port 60 may be divided into a plurality of sections (not illustrated). Moreover, each of discharge port arrays may be arranged by shifting a pitch between adjacent discharge ports as needed for reasons of dot arrangement.

A flow path configuration of a recording head serving as a primary unit of the present exemplary embodiment is described in comparison with various exemplary embodiments.

Figure 3A:
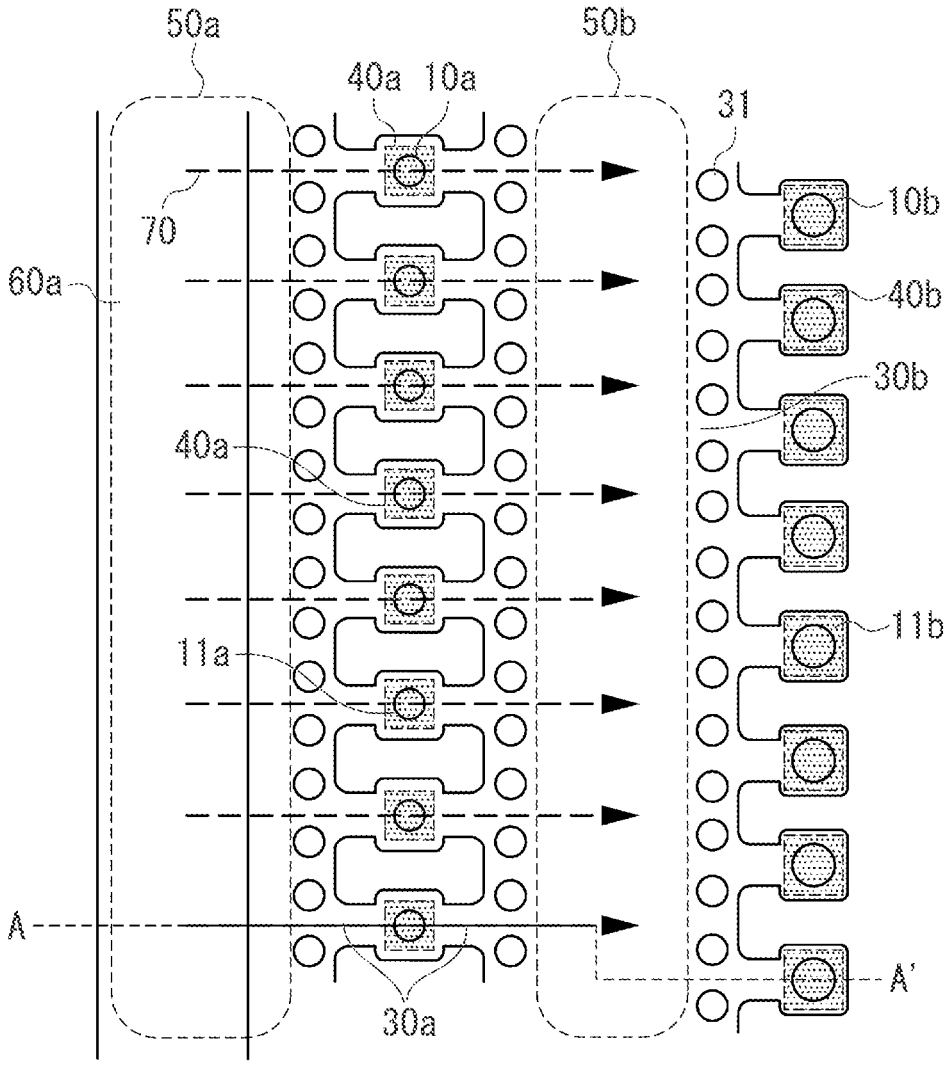
FIGS. 3A and 3B are a schematic diagram and a sectional view, respectively, illustrating a flow path according to a first exemplary embodiment.
Figure 3B:
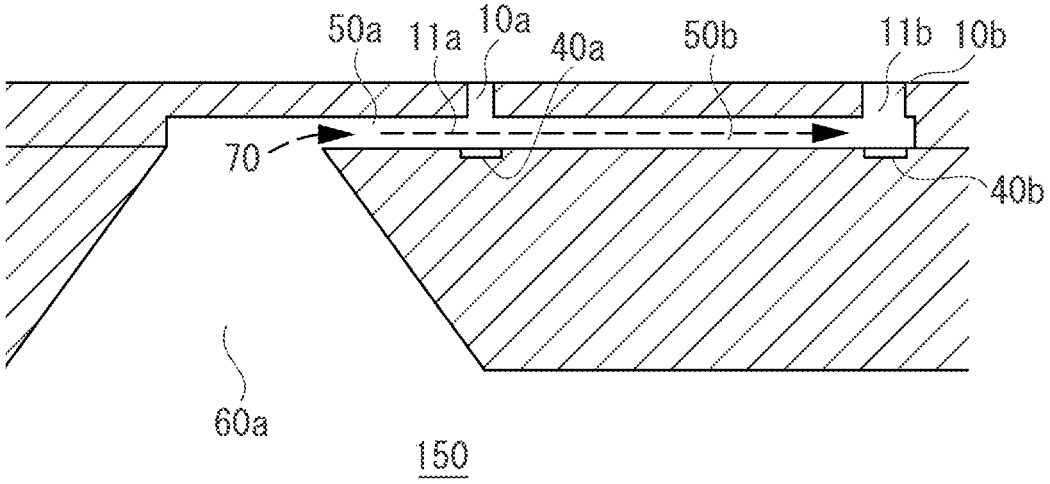

FIGS. 3A and 3B illustrate a flow path configuration of a recording head according to a first exemplary embodiment. FIG. 3A is a plan see-through view, as seen from a direction perpendicular to a substrate, illustrating a region in which a plurality of flow paths of the recording head is formed. FIG. 3B is a cross-sectional view taken along the line A-A' in FIG. 3A.

As illustrated in FIGS. 3A and 3B, each of small discharge ports 10*a* and large discharge ports 10*b* is arranged in a predetermined direction. The small discharge port 10*a* is provided opposite to a heater 40*a* serving as a first energy generation element, and the large discharge port 10*b* is provided opposite to a heater 40*b* serving as a second energy generation element. The small discharge port 10*a* discharges ink droplets each having relatively small liquid droplet volume, whereas the large discharge port 10*b* discharges ink droplets each having relatively large liquid droplet volume. The small and large discharge ports 10*a* and 10*b* are arranged parallel to each other with substantially the same arrangement pitch. Two flow paths 30*a* linearly extend from a first pressure chamber 11*a* in directions opposite to each other, the first pressure chamber 11*a* including the heater 40*a* thereinside and communicating with the small discharge port 10*a*. Each of the flow paths 30*a* has a columnar filter 31. One of the flow paths (first flow path) 30*a* communicates with a first supply port 60*a* through a common liquid chamber 50*a* on an inlet side. The other flow path (second flow path) 30*a* communicates with a second pressure chamber 11*b* through a common liquid chamber 50*b* between pressure chambers and a flow path 30*b*. The second pressure chamber 11*b* includes a heater 40*b* thereinside and communicates with the large discharge port 10*b*. In the following description, assume that a path from an inlet of the first supply port 60*a* to an inlet of the common liquid chamber 50*b* between the pressure chambers is a flow path 70.

In the present exemplary embodiment, the small discharge port 10*a* has a circular opening having a diameter of 12 μm, and an ink discharge amount (liquid droplet volume) per discharge is 2.3 pl. In the present exemplary embodiment, the large discharge port 10*b* has a circular opening having a diameter of 16 μm, and an ink discharge amount (liquid droplet volume) per discharge is 5.7 pl. In the present exemplary embodiment, a volume ratio of ink per discharge of the large discharge port 10*b* to the small discharge port 10*a* is approximately double. However, the ratio may be greater than double. The heater 40*a* for the small discharge port 10*a* is a square heat generation member having a plane dimension of 18 μm×18 μm, while the heater 40*b* for the large discharge port 10*b* is a square heat generation member having a plane dimension of 24 μm×24 μm. The first supply port 60*a* has a width of 60 μm at a portion connected to the common liquid chamber 50*a* on an inlet side.

An operation of the recording head according to the present exemplary embodiment will now be described. When printing is started, the heater 40*a* for the small discharge port 10*a* and the heater 40*b* for the large discharge port 10*b* are selectively driven based on print data, and ink is discharged from the respective discharge ports 10*a* and 10*b*. Upon discharge of the ink from the large discharge port 10*b*, ink retained in the first supply port 60*a* is supplied so that an amount of the discharged ink is replenished. The ink supplied from the first supply port 60*a* can be supplied to the second pressure chamber 11*b* including the large discharge port 10*b* through the common liquid chamber 50*a* on the inlet side, one flow path 30*a*, the first pressure chamber 11*a*, the other flow path 30*a*, and the common liquid chamber 50*b* between the pressure chambers.

When ink is discharged from the large discharge port 10*b*, ink in the common liquid chamber 50*b* between the pressure chambers flows toward the large discharge port 10*b*, so that ink in the common liquid chamber 50*a* on the inlet side flows toward the first pressure chamber 11*a*. Accordingly, as long as ink is discharged from the large discharge port 10*b*, the first pressure chamber 11*a* is constantly supplied with fresh ink in which thickening is suppressed, and ink near the small discharge port 10*a* is automatically refreshed. Therefore, even when ink evaporates from the small discharge port 10*a* in a case where ink is not discharged from the small discharge port 10*a* for a certain time period, thickening of the ink inside the first pressure chamber 11*a* can be suppressed. Consequently, for example, a discharge failure of ink discharged first after discharge from the small discharge port 10*a* is started can be suppressed. Even when ink is not discharged from the large discharge port 10*b* during printing, ink near the small discharge port 10*a* can be automatically refreshed as long as ink is discharged from the small discharge port 10*a*.

An advantage of the present exemplary embodiment is especially notable where the small discharge port 10*a* has a circular cross-section having an opening diameter ϕ of 15 μm or less, or where an opening area thereof is substantially the same as that of a case where the opening diameter is 15 μm or less. Particularly, where an ink discharge volume is 4 pl or less, the advantage is especially notable.

In the present exemplary embodiment, the first pressure chamber 11*a* including the small discharge port 10*a* and the flow path 30*a* connected to the first pressure chamber 11*a* is independently disposed from the second pressure chamber 11*b* including the large discharge port 10*b* and the flow path 30*b* connected to the large discharge port 10*b*, and the common liquid chamber 50*b* is disposed between these pressure chambers. Therefore, the possibility of crosstalk occurring between the first pressure chamber 11*a* and the second pressure chamber 11*b* is essentially eliminated. Crosstalk typically occurs due to a decrease in the degree of mutual influence between ink flow in the first pressure chamber 11*a* and ink flow in the second pressure chamber 11*b*. Consequently, when printing discharge is performed, an influence of ink discharge in the large discharge port 10*b* on ink discharge in the small discharge port 10*a* is reduced.

When preliminary discharge in which recording is not performed on a recording sheet, such as paper, is performed, preliminary discharge in the small discharge port 10*a* and preliminary discharge in the large discharge port 10*b* can be performed at optional timings without mutual constraints for the similar reasons. Also, since the preliminary discharge in the small discharge port 10*a* and the preliminary discharge in the large discharge port 10*b* can be performed simultaneously, a time needed for preliminary discharge in a preliminary discharge position can be significantly reduced, thereby enhancing printing speed.

Since ink is supplied to the first pressure chamber 11*a* through the common liquid chamber 50*a* on the inlet side, the ink is efficiently supplied to the first pressure chamber 11*a* having a shortage of the ink. In the present exemplary embodiment, the common liquid chamber 50*a* on the inlet side and the common liquid chamber 50*b* between the pressure chambers are located in locations known in the art, thereby limiting a cost incurred by complication of a configuration.

Figure 4A:
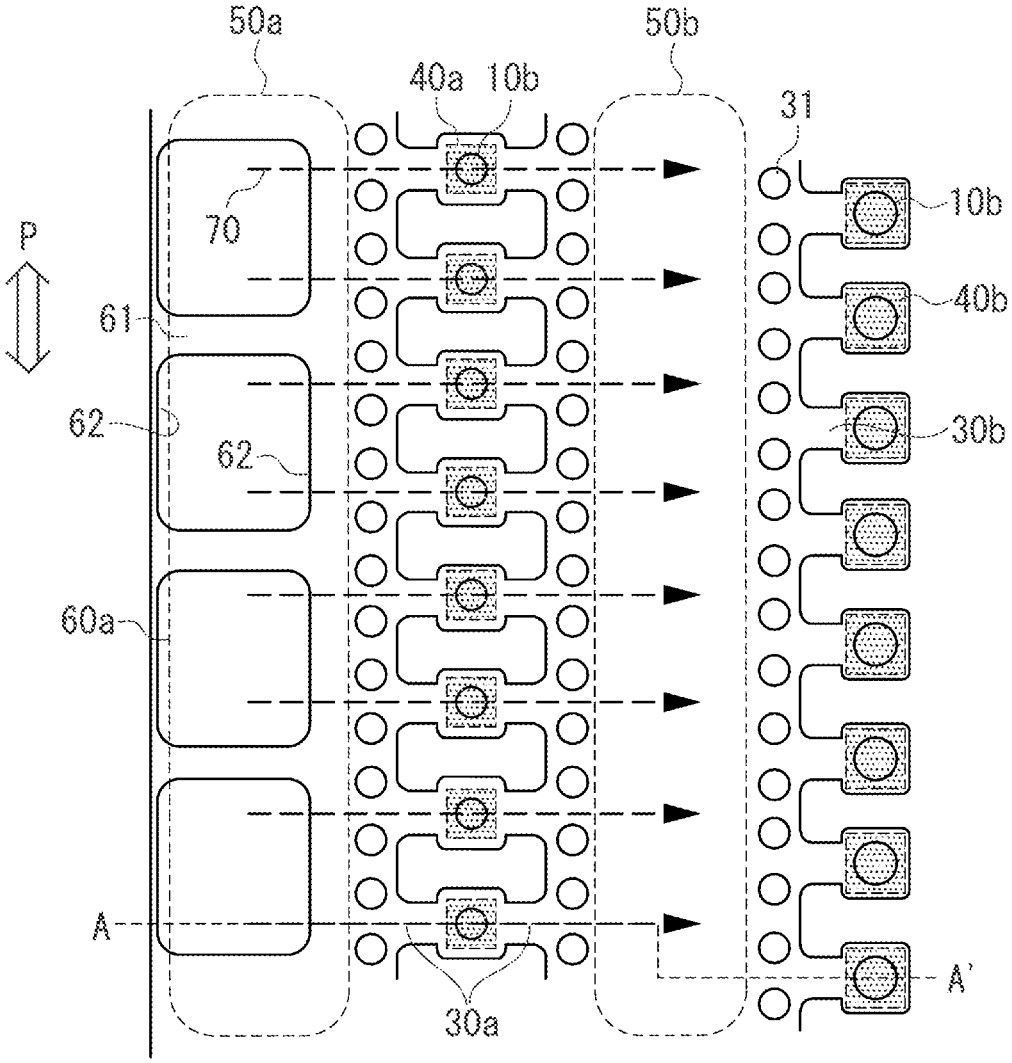
FIGS. 4A and 4B are a schematic diagram and a sectional view, respectively, illustrating a flow path according to a second exemplary embodiment.
Figure 4B:
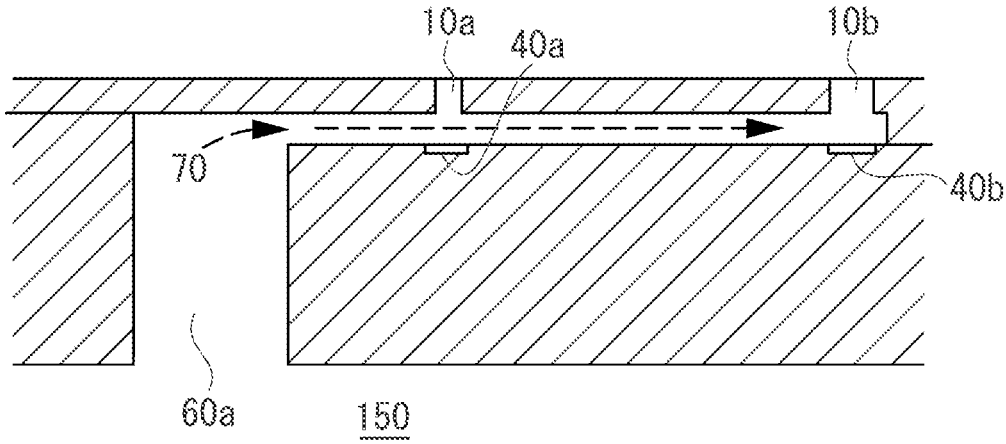

FIGS. 4A and 4B illustrate a flow path configuration of a recording head according to a second exemplary embodiment. FIG. 4A is a plan see-through view, as seen from a direction perpendicular to a substrate, illustrating a region in which a plurality of flow paths of the recording head is formed. FIG. 4B is a cross-sectional view taken along the line A-A' in FIG. 4A.

In the present exemplary embodiment, a supply port 60*a* is divided into a plurality of sections, unlike the first exemplary embodiment. That is, in the first exemplary embodiment, the first supply port 60*a* is one continuous supply port in an arranging direction of the small discharge ports 10*a*, and is provided below the common liquid chamber 50*a* on the inlet side. In the present exemplary embodiment, on the other hand, a plurality of divided sections of the first supply port 60*a* is arranged in a discharge port arranging direction P. In particular, at least one partition member 61, such as a beam member and a wall member, is disposed between side walls 62 of the first supply port 60*a* at a distance in the discharge port arranging direction P, the side walls 62 being opposite to each other. Each of the divided sections of the first supply port 60*a* has a rectangular opening having a size of 60 μm×68 μm, and is arranged at a distance twice the length of a discharge port arrangement pitch in the discharge port arranging direction P.

In a case where there are a number of discharge ports, and a supply port in the discharge port arranging direction P is long, one continuous supply port may cause a printing failure by distortion of a substrate due to an excessive increase in substrate temperature and swelling deformation of a flow path member. Moreover, in some instances, an excessive increase in temperature exerts an adverse effect on printing. A supply port is divided by disposing the partition member 61 therebetween, so that a substrate can be strengthened, and a heat radiation effect by the partition member 61 can be expected.

Figure 5A:
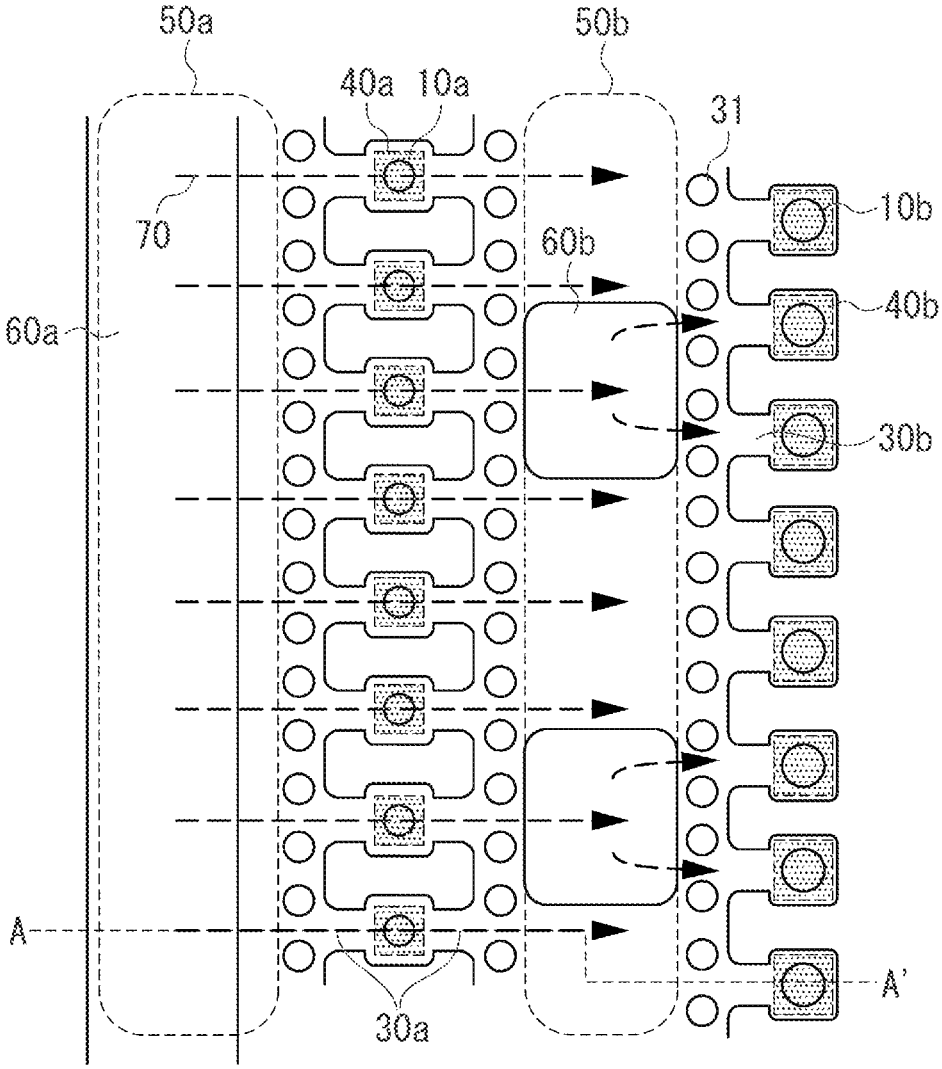
FIGS. 5A and 5B are a schematic diagram and a sectional view, respectively, illustrating a flow path according to a third exemplary embodiment.
Figure 5B:
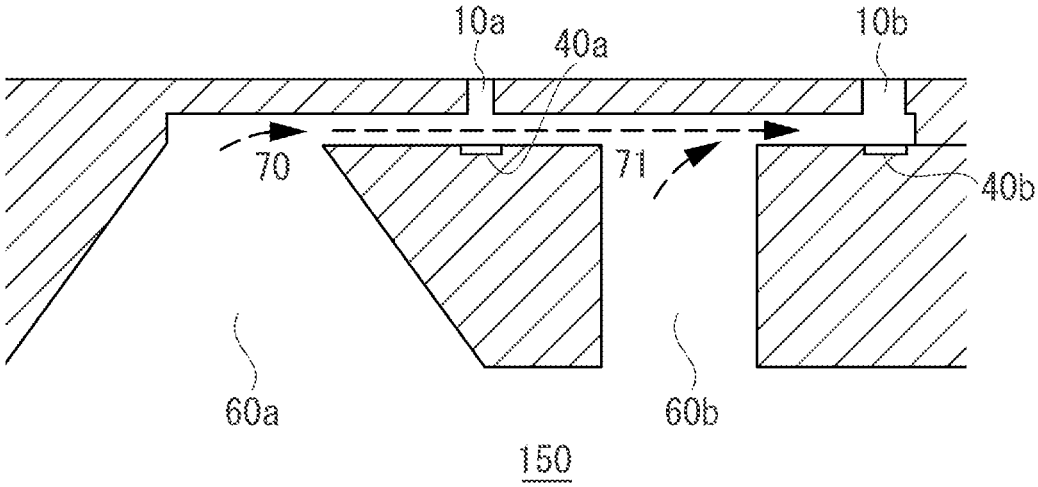

FIGS. 5A and 5B illustrate a flow path configuration of a recording head according to a third exemplary embodiment. FIG. 5A is a plan see-through view, as seen from a direction perpendicular to a substrate, illustrating a plurality of flow paths of the recording head. FIG. 5B is a cross-sectional view taken along the line A-A' in FIG. 5A.

In the present exemplary embodiment, a plurality of second supply ports 60*b* is positioned between an ink supply member (liquid supply member) 150 and a common liquid chamber 50*b* between pressure members, and causes the ink supply member 150 and the common liquid chamber 50*b* to communicate directly with each other. The second supply port 60*b* directly supplies ink stored in the ink supply member 150 to the common liquid chamber 50*b* between pressure chambers. Each second supply port 60*b* has a cross section with a rectangular opening having a size of 60 μm×68 μm, and is arranged at a distance four times the length of a discharge port arrangement pitch. In the following description, assume that a path from an inlet of the second supply port 60*b* to an inlet of the common liquid chamber 50*b* between the pressure chambers is a flow path 71.

If ink is supplied to a large discharge port 10*b* through a flow path 70 only, flow path resistance may become excessive depending on a design. Such excessive resistance not only decreases a refill frequency as a time cycle of supplying ink, but also causes a possibility of exerting an adverse effect on throughput. In the present exemplary embodiment, since the second supply port 60*b* is provided and the new flow path 71 is formed, a decrease in refill frequency can be prevented.

In the present exemplary embodiment, the second supply port 60*b* is divided into a plurality of sections (or a plurality of second supply ports 60*b* is provided). Alternatively, the second supply port 60*b* may be provided as one supply port. Similarly, a first supply port 60*a* may be divided into a plurality of sections (or a plurality of first supply ports 60*a* may be provided), or both of the supply ports 60*a* and 60*b* may be divided.

When a second supply port is provided, as in the present exemplary embodiment, a balance between a first supply port and the second supply port may need to be considered. For example, if the first supply port 60*a* is too large for the first supply port 60*a*, there are cases where ink is refilled from only the second supply port 60*b* without refilling from the first supply port 60*a* when ink is discharged from the large discharge port 10*b*. As described in the exemplary embodiment, when ink is discharged from the large discharge port 10*b*, ink from the first supply port 60*a* is suitably supplied to the large discharge port 10*b* through a flow path 30*b*. Accordingly, as illustrated in FIGS. 5A and 5B, a total area of an opening portion of the second supply port 60*b* can be smaller than that of an opening portion of the first supply port 60*a*. Moreover, the number of the second supply ports 60*b* can be greater than that of the second supply port 60*b*.

Figure 6A:
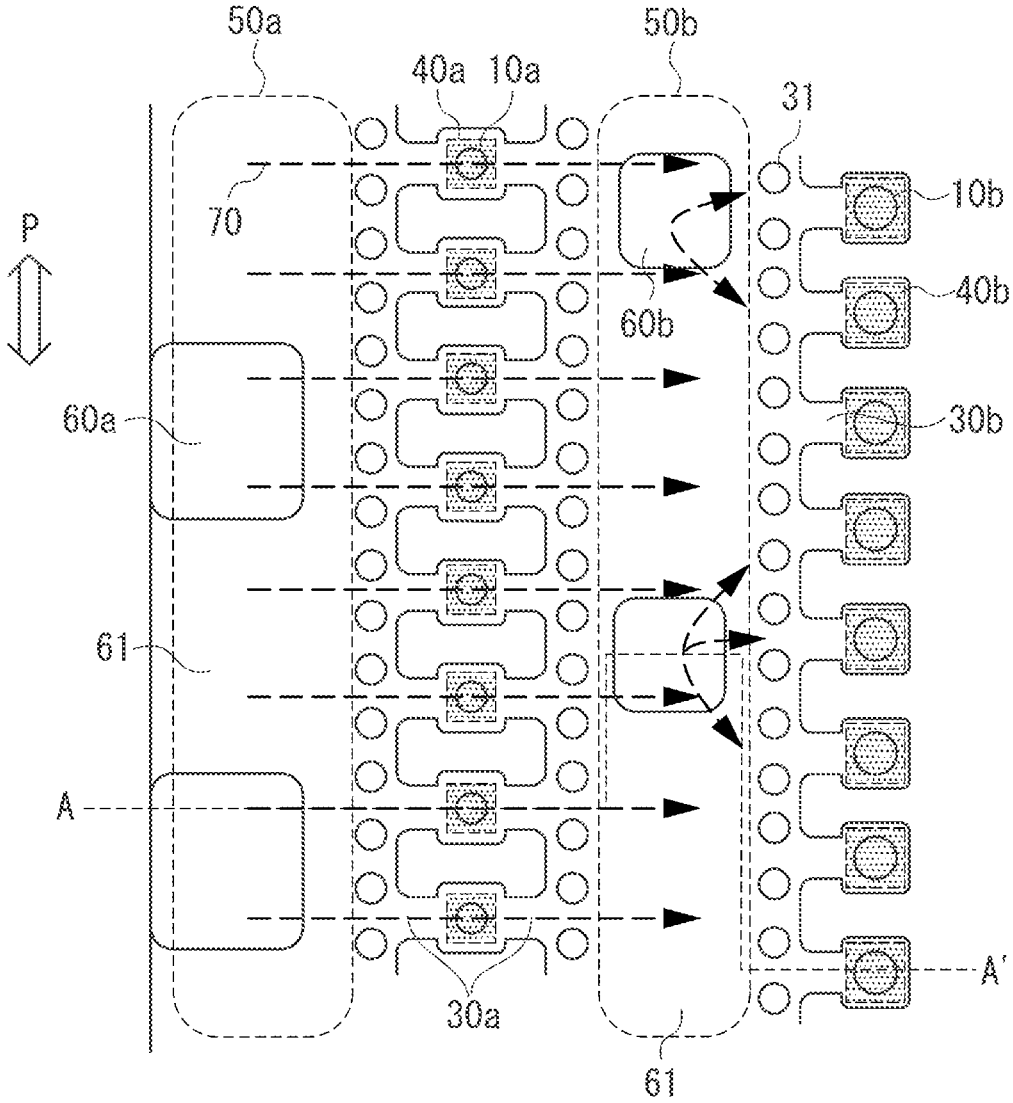
FIGS. 6A and 6B are a schematic diagram and a sectional view, respectively, illustrating a flow path according to a fourth exemplary embodiment.
Figure 6B:
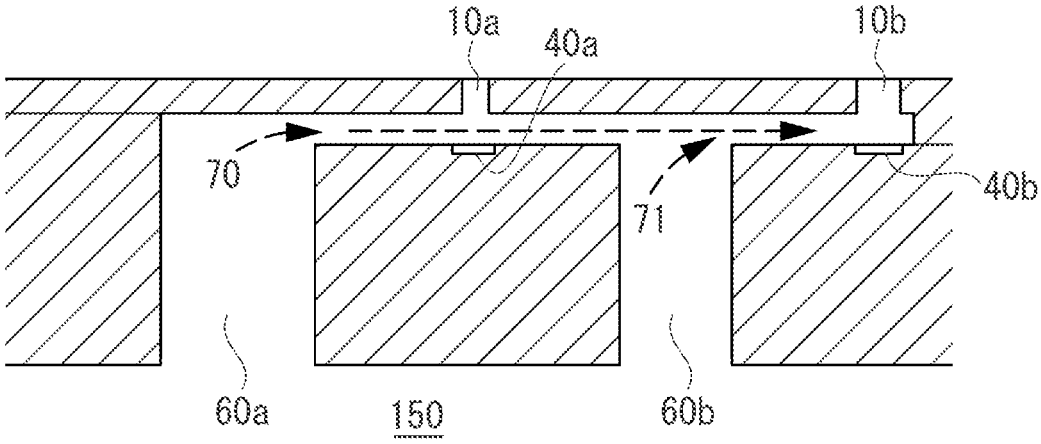

FIGS. 6A and 6B illustrate a flow path configuration of a recording head according to a fourth exemplary embodiment. FIG. 6A is a plan see-through view, as seen from a direction perpendicular to a substrate, illustrating a portion in which plurality of flow paths of the recording head is formed. FIG. 6B is a cross-sectional view taken along the line A-A' in FIG. 6A.

In the present exemplary embodiment, a plurality of first supply ports 60*a* and a plurality of second supply ports 60*b* are provided similar to the third exemplary embodiment, while a total cross-sectional area of the second supply ports 60*b* is smaller than that of the first supply ports 60*a*. Each first supply port 60*a* has a cross section with a rectangular opening having a size of 60 μm×68 μm, and each second supply port 60*b* has a cross section with a rectangular opening having a size of 42 μm×42 μm. The same number of the first supply ports 60*a* and the second supply ports 60*b* are arranged at a distance four times the length of a discharge port arrangement pitch. A space (partition member 61) between the supply ports in a discharge port arranging direction P can be used as a space in which wiring for supplying electric power to heaters 40*a* and 40*b* is arranged and a path for releasing heat of the heaters 40*a* and 40*b* to both sides.

In the present exemplary embodiment, a flow path 71 connecting an inlet of the second supply port 60*b* and an inlet of a common liquid chamber 50*b* between pressure chambers has a resistance coefficient that is set to greater than or equal to ⅕, but less than 1 of a resistance coefficient of a flow path 70 connecting an inlet of the first supply port 60*a* the and an inlet of the common liquid chamber 50*b* between pressure chambers. The reasons for such a resistance coefficient are as follows. As described in the third exemplary embodiment, the second supply port 60*b* is provided so that a decrease in refill frequency in the large discharge port 10*b* can be prevented. Based on this, it is desired that a total cross-sectional area of an opening of the second supply port 60*b* be large. For example, a total cross-sectional area of an opening of the second supply port 60*b* can be substantially the same as that of the first supply port 60*a*. Typically, however, the total cross-sectional area of opening of the second supply ports 60*b* may not need to have such a large size to prevent a decrease in refill frequency. The flow path 71 can have a total flow path resistance that is substantially the same as or less than that of the flow path 70. Accordingly, the flow path 71 can supply an amount of ink as much as an amount that flows in from the flow path 70, thereby ensuring a sufficient refill frequency. Moreover, reduction of the total cross-sectional area of opening of the second supply port 60*b* can increase volume of a partition member 61, so that heat concentrated in a middle portion of a flow path can be released efficiently.

On the other hand, if a flow path resistance of the flow path 71 is excessively low, a flow rate of ink passing through the flow path 70 decreases, and thus a discharge failure of ink to be discharged first from the small discharge port 10*a* after discharge is started is unlikely to be resolved. According to a result of experiments simulated by the present exemplary embodiment, an average ink discharge flow rate (flow rate of ink passing through the flow path 70) from the small discharge port 10*a* is approximately 15% of an average ink discharge flow rate (total flow rate of ink passing through the flow paths 70 and 71) from the large discharge port 10*b* in normal printing. This flow rate ratio can be achieved by setting a total flow path resistance of the flow path 71 to be greater than or equal to ⅕ of that of the flow path 70. However, the total flow path resistance ratio between the flow path 70 and the flow path 71 is not limited to such an example. Alternatively, the total flow path resistance ratio between the flow path 70 and the flow path 71 may be changed according to an ink discharge rate ratio between the large discharge port 10*b* and the small discharge port 10*a*.

Figure 7A:
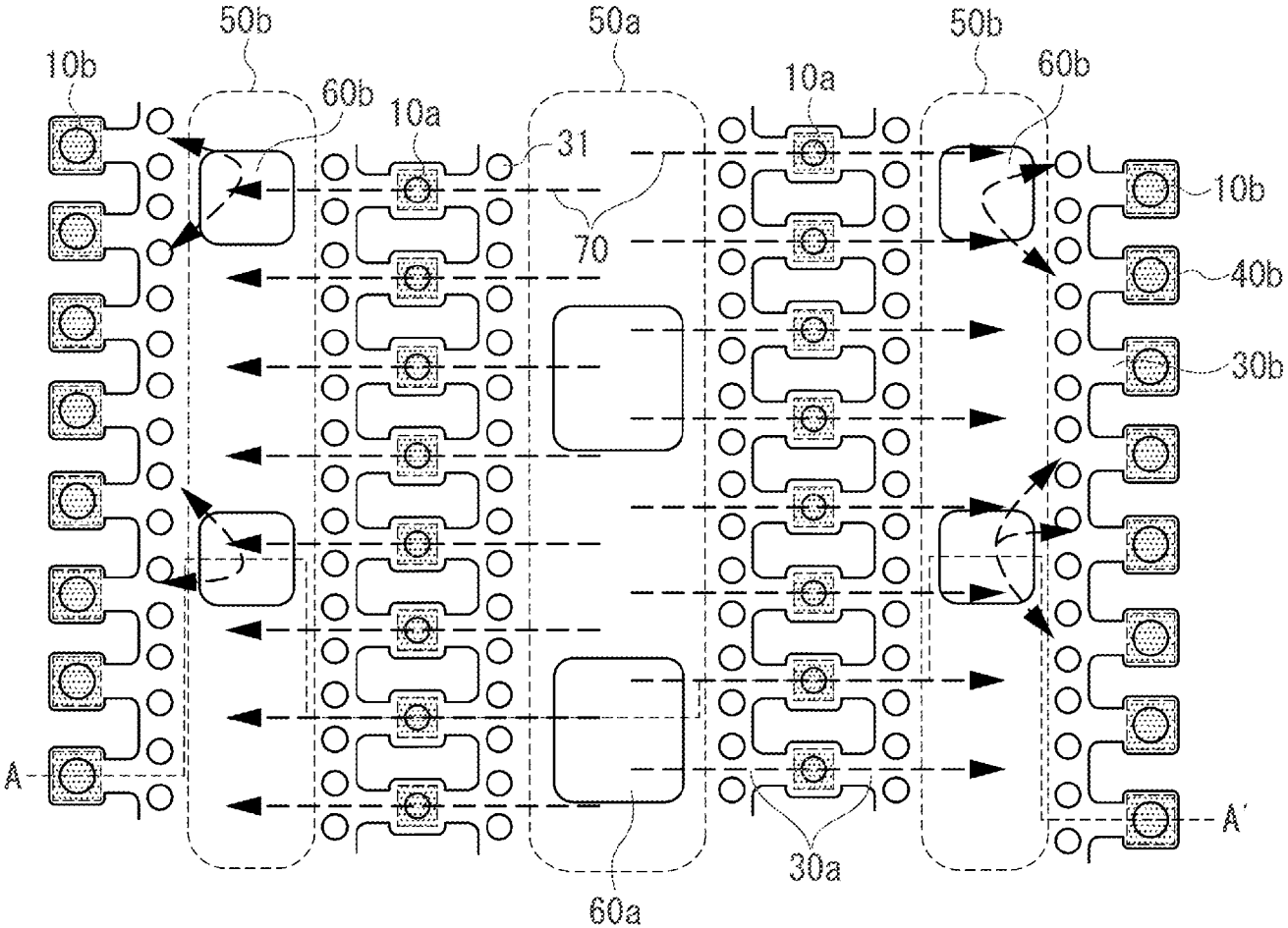
FIGS. 7A and 7B are a schematic diagram and a sectional view, respectively, illustrating a flow path according to a fifth exemplary embodiment.
Figure 7B:
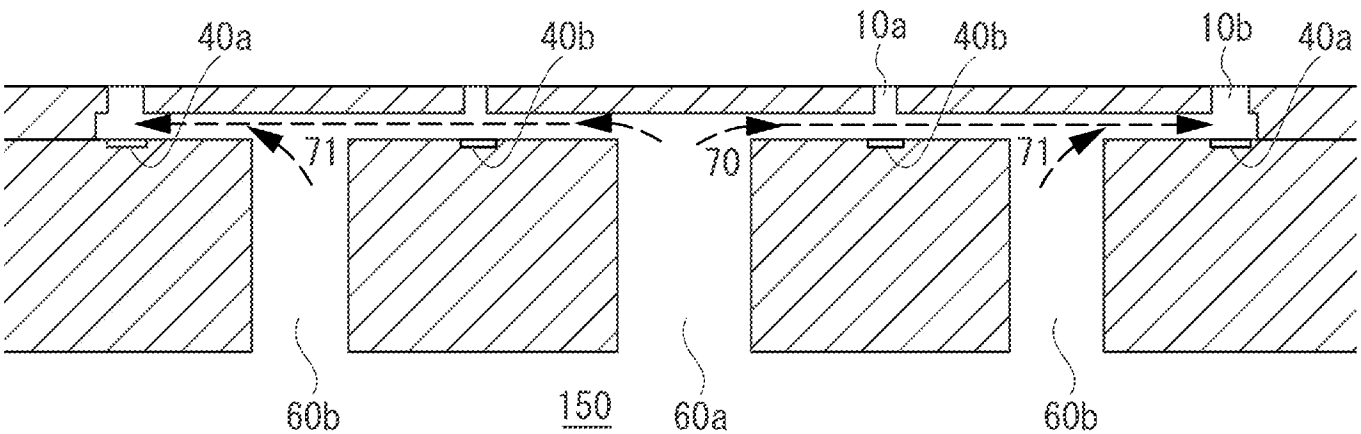

FIGS. 7A and 7B illustrate a flow path configuration of a recording head according to a fifth exemplary embodiment. FIG. 7A is a plan see-through view, as seen from a direction perpendicular to a substrate, illustrating a portion in which plurality of flow paths of the recording head is formed. FIG. 7B is a cross-sectional view taken along the line A-A' in FIG. 7A.

Unlike the fourth exemplary embodiment, each of large discharge ports 10*b* and small discharge ports 10*a* is arranged in a plurality of arrays (two arrays in this case). A flow of ink branches off to the right and left from a first supply port 60*a* in the middle, and the ink is supplied to the two arrays of the small discharge ports 10*a* and then supplied further out to the large discharge ports 10*b*. According to the present exemplary embodiment, the number of discharge ports can be doubled, and printing speed can be further enhanced.

Figure 8A:
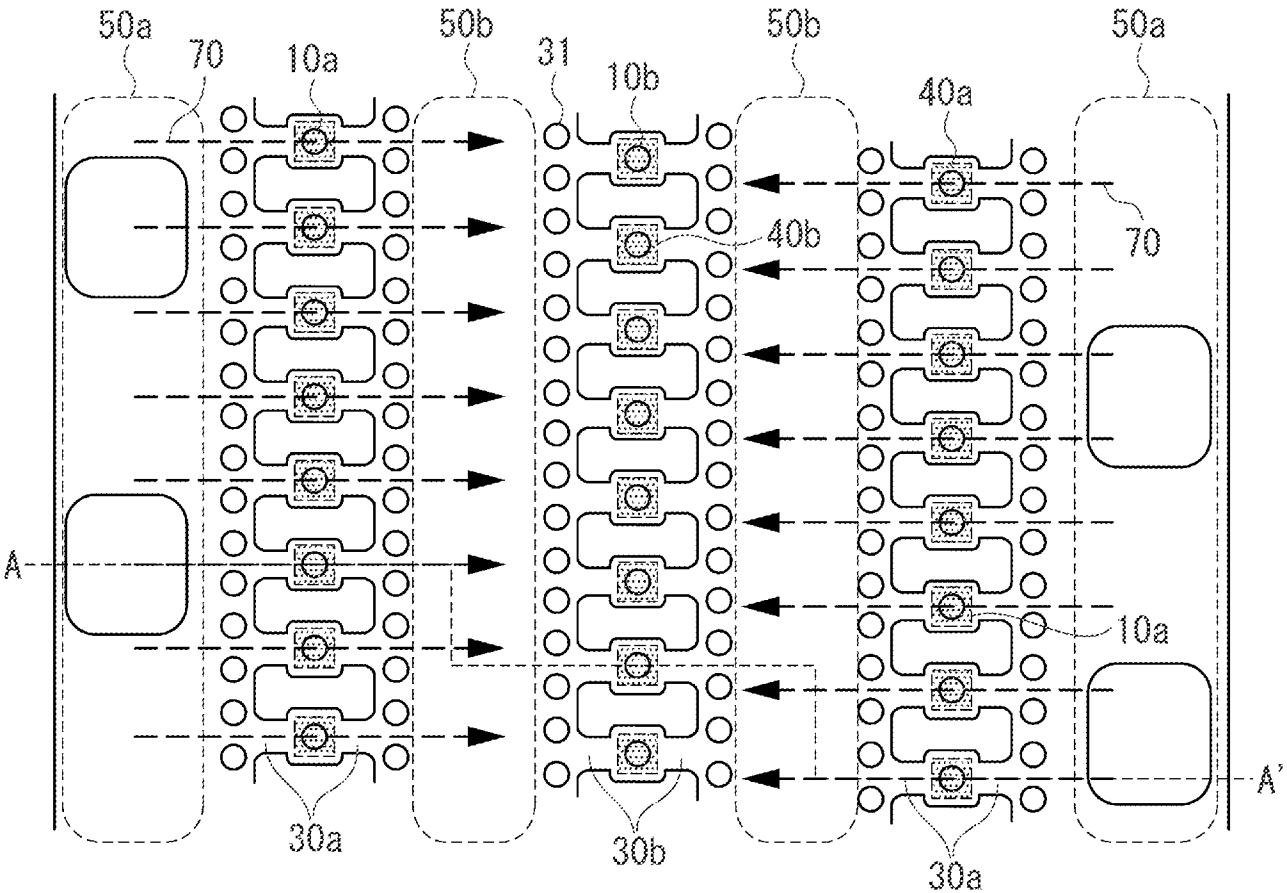
FIGS. 8A and 8B are a schematic diagram and a sectional view, respectively, illustrating a flow path according to a sixth exemplary embodiment.
Figure 8B:
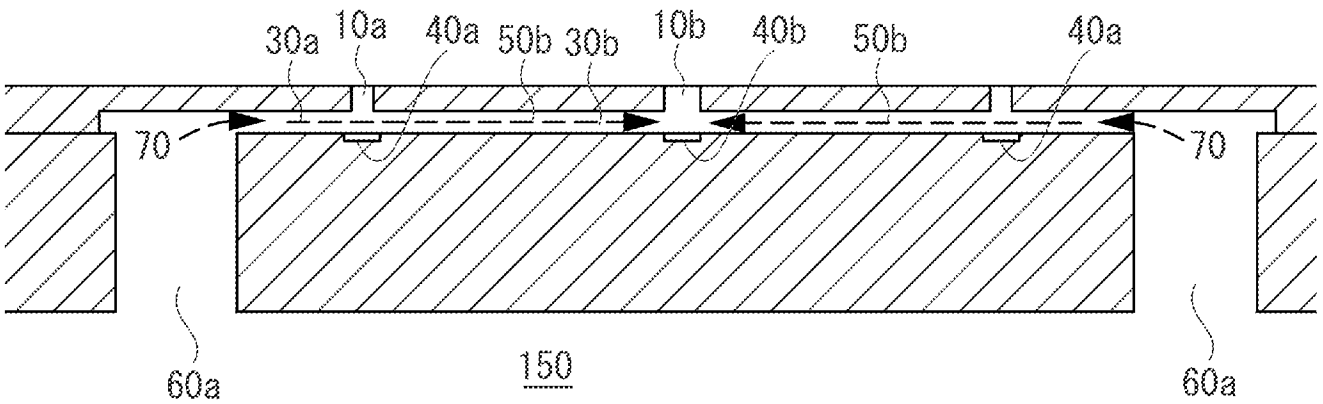

FIGS. 8A and 8B illustrate a flow path configuration of a recording head according to a sixth exemplary embodiment. FIG. 8A is a plan see-through view, as seen from a direction perpendicular to a substrate, illustrating a portion in which plurality of flow paths of the recording head is formed. FIG. 8B is a cross-sectional view taken along the line A-A' in FIG. 8A.

Like the fifth exemplary embodiment, small discharge ports 10*a* are arranged in two arrays, and flow paths 30*a* are disposed on the outer side of the small discharge ports 10*a*. The flow path 30*a* is a path to a common liquid chamber 50*a* on an inlet side. Large discharge ports 10*b* are arranged in one array, and ink is supplied from a common liquid chamber 50*b* between two pressure chambers. According to the present exemplary embodiment, the number of the small discharge ports 10*a* is double, and thus printing speed can be further enhanced. Moreover, since there are two flow paths to the discharge port 10, a decrease in refill frequency can be prevented without adding a second supply port 60*b*.

Figure 9A:
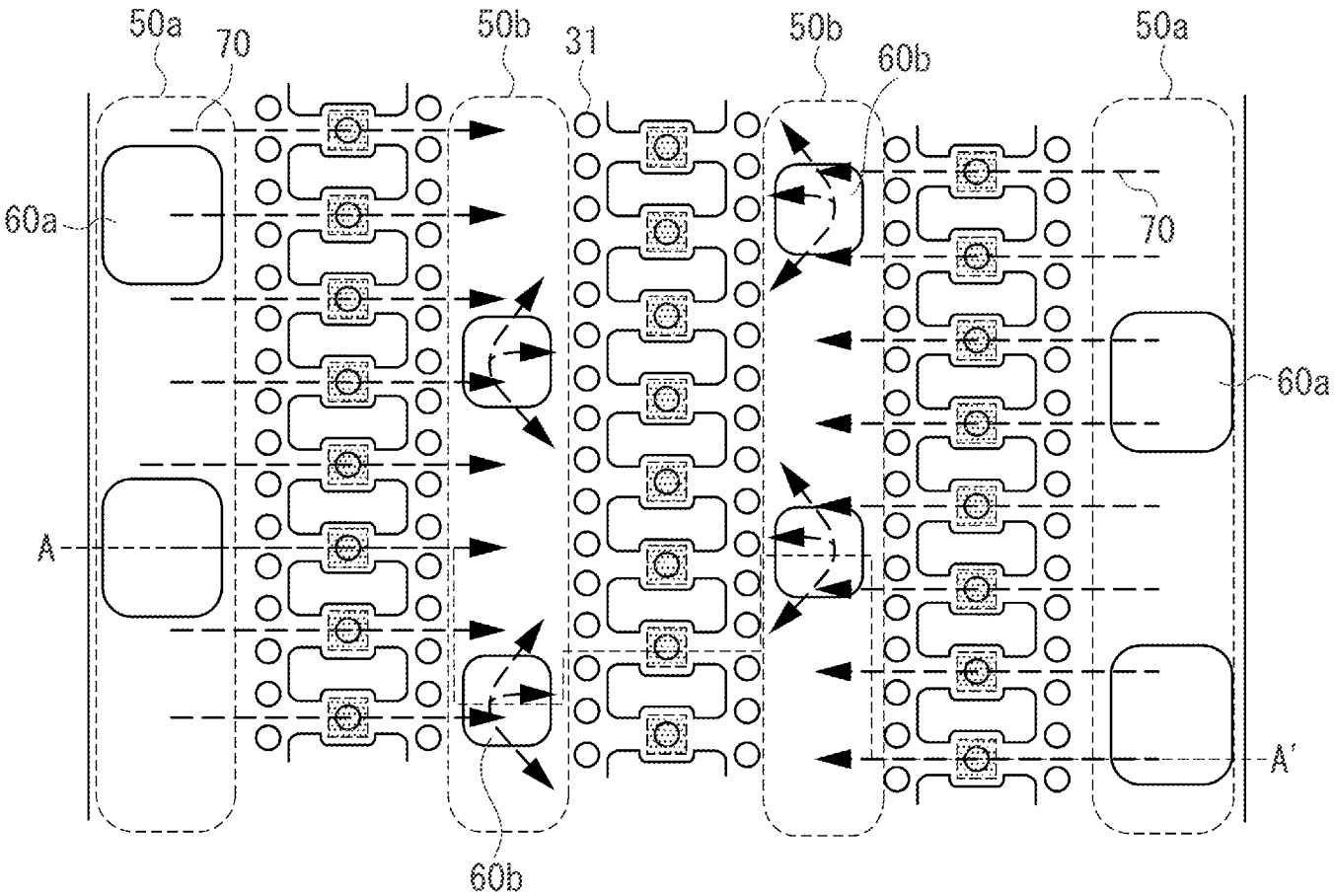
FIGS. 9A and 9B are a schematic diagram and a sectional view, respectively, illustrating a flow path according to a seventh exemplary embodiment.
Figure 9B:
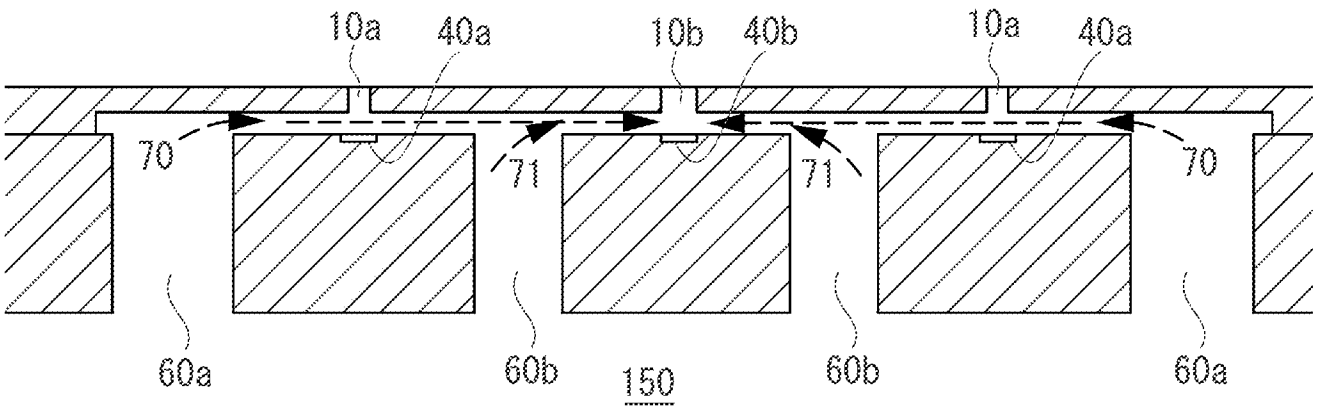

FIGS. 9A and 9B illustrate a flow path configuration of a recording head according to a seventh exemplary embodiment. FIG. 9A is a plan see-through view, as seen from a direction perpendicular to a substrate, illustrating a plurality of flow paths of the recording head. FIG. 9B is a cross-sectional view taken along the line A-A' in FIG. 9A.

Unlike the sixth exemplary embodiment, a second supply port 60*b* communicating with a common liquid chamber 50*b* between pressure chambers is added. The second supply port 60*b* has a cross-sectional area that is smaller than that of a first supply port 60*a*. A dimension of the cross-sectional areas is the same as that of the fourth exemplary embodiment. The first supply port 60*a* is rectangular having a size of 60 μm×68 μm (per port), whereas the second supply port 60*b* is rectangular having a size of 42 μm×42 μm (per port). The first supply ports 60*a* and the second supply ports 60*b* are arranged at a distance four times the length of a discharge port arrangement pitch. According to the present exemplary embodiment, not only can a decrease in refill frequency be prevented, but the refill frequency can actually be increased. Therefore, printing speed can be enhanced without increasing the number of the large discharge ports 10*b* as described in the fifth exemplary embodiment.

In each of the above-described exemplary embodiments, a supply port is formed as a through hole on an element substrate 110. However, aspects of the present invention are not limited thereto. For example, a flow path forming member 111 having discharge ports may be provided in a laminated configuration, and a pressure chamber and a supply port may be formed.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2011-207694 filed Sep. 22, 2011, which is hereby incorporated by reference herein in its entirety.

What is claimed is:

1. A liquid discharge head comprising:

a plurality of discharge ports configured to discharge liquid;

a supply port configured to retain the liquid to be discharged from the plurality of discharge ports;

a first pressure chamber including a first energy generation element to discharge a predetermined amount of liquid droplets;

a second pressure chamber including a second energy generation element to discharge an amount of liquid droplets greater than the predetermined amount;

a first flow path through which the supply port and the first pressure chamber communicate with each other; and a second flow path through which the first pressure chamber and the second pressure chamber communicate with each other, wherein a second supply port through which the first pressure chamber and the second pressure chamber communicate with each other and which is different from the supply port is formed between the first pressure chamber and the second pressure chamber as viewed from the direction in which the liquid droplets are discharged from the discharge port.

2. The liquid discharge head according to claim 1, wherein the supply port, the first pressure chamber, and the second pressure chamber are arranged in this order as viewed from a direction in which the liquid droplets are discharged from the discharge port.

3. The liquid discharge head according to claim 1, wherein the liquid retained by the supply port is supplied to the second pressure chamber through the first flow path and the second flow path.

4. The liquid discharge head according to claim 1, wherein a plurality of the first energy generation elements and a plurality of the second energy generation units are arranged parallel to each other in a predetermined arrangement direction.

5. The liquid discharge head according to claim 4, wherein the supply port is formed along the predetermined arrangement direction.

6. The liquid discharge head according to claim 4, wherein a plurality of supply ports is arranged along the predetermined arrangement direction.

7. The liquid discharge head according to claim 1, wherein the first flow path and the second flow path are formed linearly.

8. The liquid discharge head according to claim 1, wherein a total opening area of the second supply port is smaller than a total opening area of the supply port.

9. The liquid discharge head according to claim 1, wherein a number of the second supply ports is greater than a number of the supply ports.

10. The liquid discharge head according to claim 1, wherein a volume of the liquid droplets discharged by driving the first energy generation element is at least double a volume of the liquid droplets discharged by driving the second energy generation element.

11. The liquid discharge head according to claim 1, wherein the first pressure chamber is connected to two flow paths and the second pressure chamber is connected to one flow path.

12. The liquid discharge head according to claim 1, wherein the first energy generation element and the second energy generation element are formed on a substrate.

13. The liquid discharge head according to claim 12, wherein the supply port is formed by a through hole passing though the substrate.

* * * * *